US006158554A

United States Patent [19]

Ferrari

[11] Patent Number: 6,158,554

[45] Date of Patent: Dec. 12, 2000

[54] SAFETY DEVICE FOR MOVING THE LIFT CABIN IN CASE OF FAULT OF THE MAIN LIFTING SYSTEM

[75] Inventor: Carlo Ferrari, Moncalieri, Italy

[73] Assignee: Officine Ferrari S.N.C. DiCarlo E Mario Ferrari & C., Italy

[21] Appl. No.: 09/323,973

[22] Filed: Jun. 2, 1999

[30] Foreign Application Priority Data

Jun. 12, 1998 [IT] Italy ..... TO98A0514

[51] Int. Cl.[7] ..... B66B 1/42; B66B 5/02; B66B 7/08

[52] U.S. Cl. ..... 187/348; 187/350; 187/284

[58] Field of Search ..... 187/350, 314, 187/250–253, 348, 284

[56] References Cited

U.S. PATENT DOCUMENTS

| | | | |
|---|---|---|---|
| 601,535 | 3/1898 | Taylor | 187/350 |
| 606,489 | 6/1898 | Paroselli | 187/348 |
| 1,955,333 | 4/1934 | Jackson | 187/350 |
| 1,987,719 | 1/1935 | Sprague | 187/350 |
| 4,540,329 | 9/1985 | Martin | 187/350 |

FOREIGN PATENT DOCUMENTS

| | | | |
|---|---|---|---|
| 364682 | 8/1906 | France | 187/350 |
| 2 645 131 A1 | 5/1990 | France . | |
| 585348 | 8/1906 | Italy | 187/350 |
| 1240805 | 12/1993 | Italy . | |

*Primary Examiner*—Robert P. Olszewski
*Assistant Examiner*—Thuy V. Tran
*Attorney, Agent, or Firm*—Ratner & Prestia

[57] ABSTRACT

A safety device in a lift system comprising a cabin moveable along a shaft for moving the cabin in the event of a fault of the main lifting system. The safety device includes a platform located below the base of the lift cabin. Further, engagement apparatus selectively renders the platform integral with the lift shaft and lifting apparatus lifts the cabin in respect of the platform.

10 Claims, 3 Drawing Sheets

SAFETY DEVICE FOR MOVING THE LIFT CABIN IN CASE OF FAULT OF THE MAIN LIFTING SYSTEM

BACKGROUND OF THE INVENTION

The present invention relates to a safety device for moving the cabin of a lift or elevator in case of a fault of the main lifting system.

More particularly, the invention concerns an auxiliary safety device for a lift system, adapted to displace upwardly a car or cabin stopped between two floors, to the level of the right above floor for allowing the passengers disembarkation.

As it is known when a sudden fault occurs in the main lifting system of a lift, the cabin can stay blocked between two floors at a level not allowing for the evacuation of the passengers.

Under the above circumstances it becomes necessary to move the cabin either upwardly or downwardly so as to return the cabin to a level corresponding to the nearest floor exit.

Italian patent No. 1 240 805 discloses a method for moving the cabin of a lift or hoist that has accidentally stopped between two floors.

In the system disclosed by patent No. 1 240 805 the cabin is housed within a cage having a height at least equal to the height of the cabin inclusive of its outer service members and augmented by the distance between the levels of two consecutive floor exits.

This cage is securely attached to the main lifting system but the cabin can be displaced upwardly or downwardly inside the cage through an auxiliary lifting device.

In case the cabin remains trapped between two floors, the cabin is caused to slidably move inside the cage, by the safety device, until it reaches a floor exit.

The cabin movement inside the cage is stopped when the cabin reaches the level of a floor exit, and then the lift door is opened to allow the passengers to evacuate the cabin.

A first drawback of the method disclosed by Italian patent No. 1 240 805 derives from the size of the cage in which the cabin is housed.

Namely, due to the cage presence the lift shaft need to be larger than usual, both in the lateral size and height.

For this reason the method disclosed by the above Italian patent cannot be employed in an already existing lift system, unless the cabin size is rendered so small that a properly dimensioned cage can be fitted inside the existing shaft.

SUMMARY OF THE INVENTION

A first object of the present invention is therefore to overcome the above drawbacks by providing a safety device that can be easily fitted to existing lift systems.

The method disclosed by the above Italian patent has the further drawback of requiring a rather heavy metal frame for housing the cabin.

As a consequence the lifting system must be designed with a larger power rating in order to lift both the cage and the cabin, thus increasing the costs for manufacturing and operating the lift installation.

Another object of the present invention is therefore to realize a safety device that is lightweight and inexpensive to be manufactured.

The above and other objects of the present invention are achieved through a safety device for moving a lift cabin in case of a fault of the main lifting system as claimed in the attached claims.

Further characteristics and advantages of the invention will become evident from the following description of a preferred but not limiting embodiment illustrated in the attached drawing in which:

DETAILED DESCRIPTION OF PREFERRED EMBODIMENT

Figure 1:
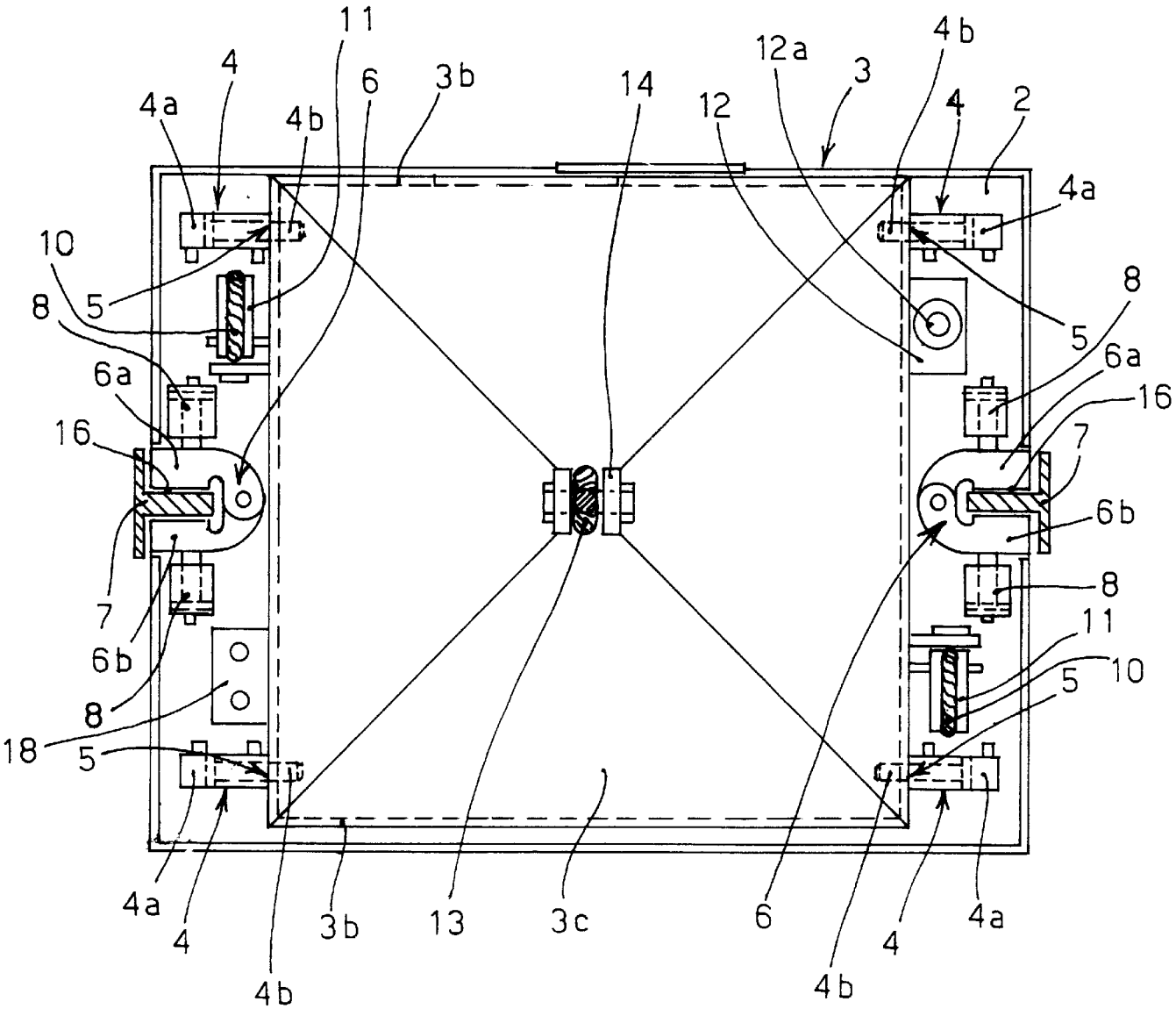
FIG. 1 is a top view of a cabin in a lift system equipped with a device according to the invention.
Figure 2:
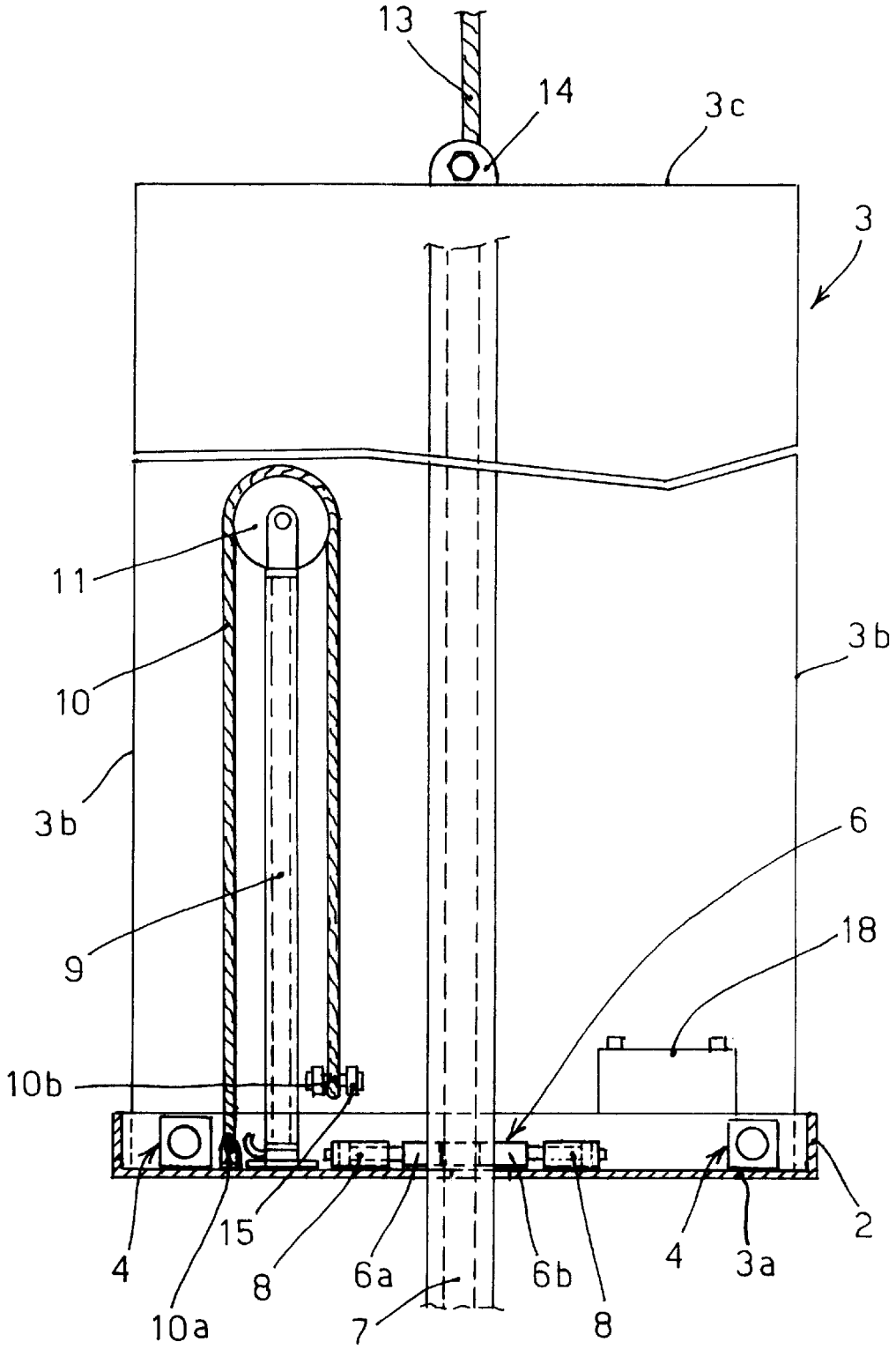
FIG. 2 is a partially cross-sectioned side view of the cabin shown in FIG. 1;.
Figure 3:
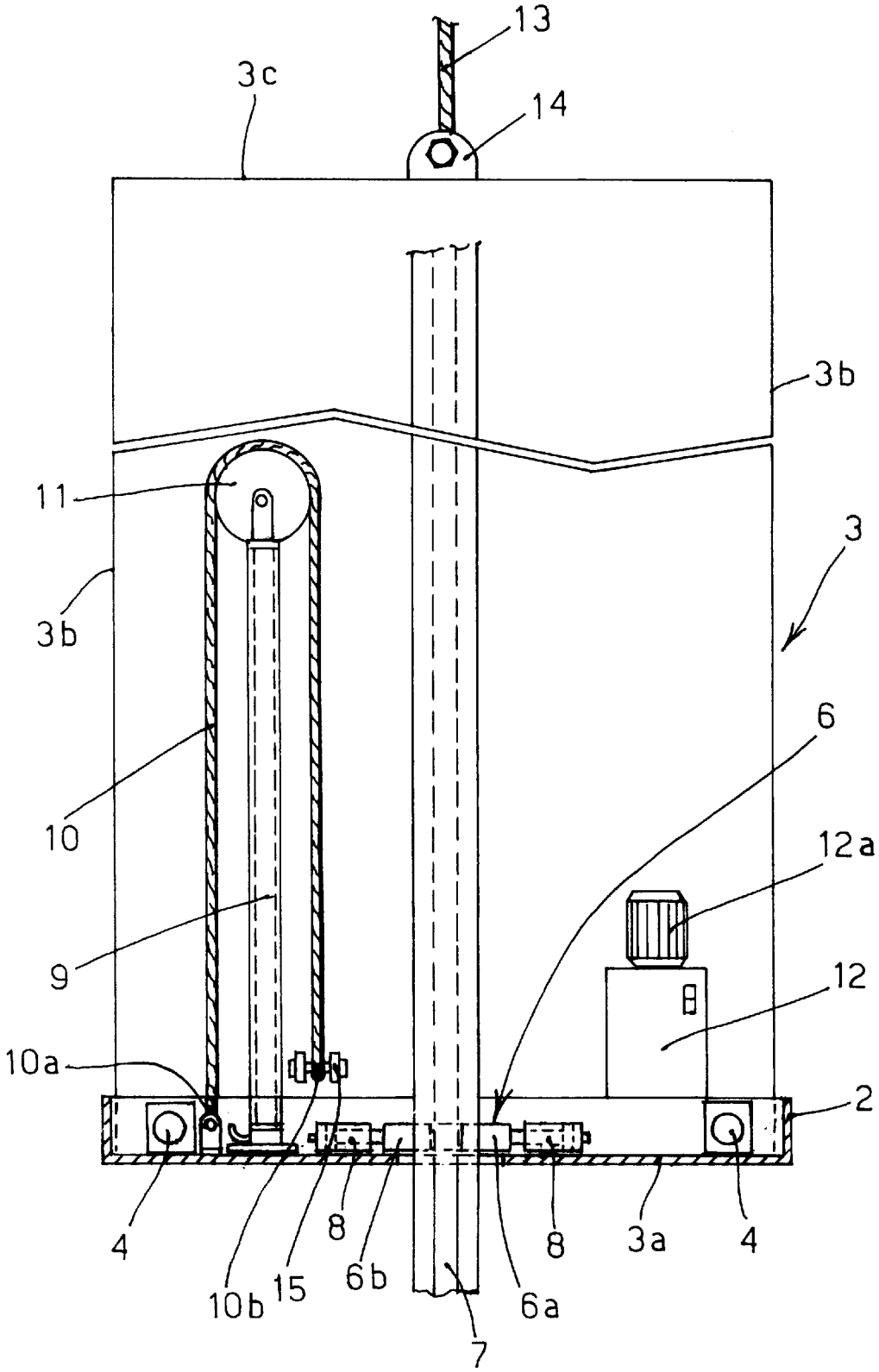
FIG. 3 is a partially cross-sectioned side view of the cabin shown in FIG. 1 from the opposed side with respect of the view shown in FIG. 2.

With reference to the attached Figures there is illustrated a cabin 3 of a lift system, having a substantially parallelepipedal shape and comprising a base 3*a*, sides 3*b* and a roof 3*c*, such cabin being housed within the shaft of a lift system, between two vertical guides or rails 7.

The cabin 3 can be lifted and lowered along the lift shaft by means of a main lifting system that is known in the art and comprises a cable 13 secured to the roof 3*c* of the cabin 3 through a loop 14.

The Figures further illustrate a safety device according to the invention that comprises a platform 2, having a substantially rectangular shape, formed by a metal plate with the edges folded by 90ø, located under the base 3*a* of the cabin 3.

Said platform 2 can be selectively secured to or rendered integral with the base 3*a* of the lift cabin 3 by means of two pairs of opposite oil cylinders 4, each having the body 4*a* secured to said platform 2 and the corresponding piston 4*b* extendable into corresponding holes 5 formed in the sides of the base 3*a* of the cabin 3.

After the pistons 4*b* have been extended and inserted into the holes 5, the platform 2 is rendered integral with the cabin 3 and follows the upwardly or downwardly motion thereof caused by the main lifting system.

Said platform 2 further comprises two pairs of blocking jaws 6, formed by shoes 6*a*, 6*b* that can be clamped to the vertical guides 7 provided in the lift shaft for allowing the lift motion, thus rendering the platform 2 integral with the guides 7.

In correspondence of the guides 7 two rectangular recesses 16 are provided in said platform 2, such recesses being formed between the two shoes 6*a*, 6*b* for allowing the insertion of the platform 2 between the guides 7.

The shoes 6*a*, 6*b* of each jaw 6 are driven by corresponding oil cylinders 8,8 for closing and opening the jaws 6 with respect to the guides 7.

Said platform 2 further carries two vertical oil cylinders 9 laterally positioned in respect of two opposed sides 3*b* of the cabin 3. When the vertical oil cylinders 9 are being extended each of them pulls—through a pulley 11—a corresponding rope or chain 10 having one end 10*a* secured to the platform 2 and the other end 10*b* laterally fastened to the cabin 3 through loops 15 provided on the two opposed sides of the cabin 3.

When the platform 2 is disengaged from the cabin 3 and the cylinders 9 are being extended, the ropes 10 are tautened and as a consequence the cabin 3 is lifted in respect of the platform 2.

On said platform 2 there are further disposed a hydraulic circuit (not shown) for actuating the oil cylinders 4, 8 and 9, and a hydraulic central unit 12 for selectively actuating said oil cylinders 4, 8 and 9.

Such hydraulic central unit 12 further comprises an electric motor 12*a* and a pump (not shown) for pressurizing the oil in the hydraulic circuit.

Further electronic and electromechanical devices are provided for actuating an automatic lifting cycle of the cabin 3 in respect of the platform 2 and for actuating a reverse cycle to restore the usual working conditions.

Such devices have not been disclosed and illustrated since they are conventional and well known the average skilled person.

Moreover a battery 18 is secured to said platform 2 for feeding the electric motor 12*a*, the central unit 12 and the other electrical and electromechanical devices.

The lifting cycle of the cabin 3 in respect of the platform 2 is carried out when the cabin 3 accidentally stops between two floors and becomes necessary to disembark the passengers.

The cycle can be started either through a control member provided inside the cabin 3 or through a control member located outside the cabin.

The lifting cycle includes the following steps:

1. the main lifting system is de-energized;
2. through the oil pistons the shoes are clamped against the guides 7 thus blocking together the frame 2 and the guides;
3. the pistons 4*b* are retracted into the oil cylinders 4 thus disengaging the cabin 3 from the platform 2;
4. the cabin 3, that is now free from the platform 2, is lifted from the platform 2 (now blocked to the guides 7), until it reaches the level corresponding to the right above floor exit;
5. the door of the cabin 3 is opened to allow the passengers to disembark.

The reverse cycle is executed by repeating the above steps in reverse order.

It is to be noted that when the cabin 3 is being lifted from the platform 2, the cable 13 of the main lifting system will become slack and will rest upon the roof of the cabin 2, without hindering the upwardly motion of the cabin.

What is claimed is:

1. A safety device in a lift system comprising a cabin movable along a shaft, for moving said cabin in case of a fault of the main lifting system, said device comprising:

a platform located below the base of said lift cabin;

engagement means for selectively rendering said platform integral with the lift shaft;

lifting means for lifting said cabin in respect of said platform.

2. A device as claimed in claim 1, wherein said platform comprises additional engagement means adapted to render said platform integral with the base of said cabin.

3. A device as claimed in claim 2, wherein said additional engagement means comprises two pairs of opposite oil cylinders, the extendable ends of which can be inserted into corresponding holes laterally provided in the base of the cabin.

4. A device as claimed in claim 1, wherein said engagement means comprises a pair of jaws adapted to clamp vertical guides provided inside the lift shaft in which said cabin is movable.

5. A device as claimed in claim 4, wherein each of said jaws comprises a pair of shoes that can grip or release said guides under the control of oil pistons.

6. A device as claimed in claim 1, wherein said lifting means comprises two vertical oil cylinders.

7. A device as claimed in claim 6, wherein said oil cylinders are secured to said platform and are laterally positioned to said cabin, in correspondence of two opposed sides.

8. A device as claimed in claim 7, wherein a pulley is located at the extendable end of said oil cylinders, with a rope or chain being turned around said pulley, one end of said rope or chain being secured to said platform and the other end being laterally secured to said cabin.

9. A device as claimed in claim 2, wherein said platform further carries an hydraulic circuit for controlling said engagement means, additional engagement means and said lifting means and a battery, an electric motor and a pump for pressurizing said hydraulic circuit.

10. A lift cabin for a lift system comprising a main lifting system for moving the cabin along a lift shaft, wherein said cabin is provided with a safety device for moving said cabin in case of a fault of the main lifting system, said safety device comprising:

a platform located below the base of said lift cabin;

engagement means for selectively rendering said platform integral with the lift shaft;

lifting means for lifting said cabin in respect of said platform.

* * * * *